US006478017B2

(12) United States Patent
Bianchi

(10) Patent No.: US 6,478,017 B2
(45) Date of Patent: Nov. 12, 2002

(54) INTERNAL-COMBUSTION ENGINE PROVIDED WITH AN EXHAUST GAS RECIRCULATION SYSTEM, IN PARTICULAR FOR A VEHICLE

(75) Inventor: Pietro Bianchi, Turin (IT)

(73) Assignee: Iveco Fiat S.p.A., Turin (IT)

( * ) Notice: Subject to any disclaimer, the term of this patent is extended or adjusted under 35 U.S.C. 154(b) by 0 days.

(21) Appl. No.: 09/853,697

(22) Filed: May 14, 2001

(65) Prior Publication Data

US 2002/0005190 A1 Jan. 17, 2002

(30) Foreign Application Priority Data

May 12, 2000 (IT) ..... TO00A0445

(51) Int. Cl.[7] ..... F02M 25/97
(52) U.S. Cl. ..... 123/568.12; 123/568.11
(58) Field of Search ..... 123/568.12, 568.13

(56) References Cited

U.S. PATENT DOCUMENTS

| | | | | |
|---|---|---|---|---|
| 4,106,449 A | | 8/1978 | Matsumoto et al. | 123/119 A |
| 4,328,781 A | | 5/1982 | Morita | 123/570 |
| 4,413,605 A | | 11/1983 | Leoni | 123/547 |
| 4,643,157 A | | 2/1987 | Nishikawa et al. | 123/568 |
| 5,732,688 A | * | 3/1998 | Charlton et al. | 123/568.12 |
| 5,762,051 A | | 6/1998 | Okamoto | 123/568 |
| 5,979,421 A | | 11/1999 | Yamashita et al. | 123/568.12 |

FOREIGN PATENT DOCUMENTS

| | | |
|---|---|---|
| DE | 196 42 685 | 4/1998 |
| JP | 07-259653 | 9/1995 |

OTHER PUBLICATIONS

Opel's New 1,4 and 1,6 Liter Four–Valve Engine; Breitwieser et al. vol. 56, No. 4, 1995, pp. 186–189.

* cited by examiner

*Primary Examiner*—Paul J. Hirsch
*Assistant Examiner*—Arnold Castro
(74) *Attorney, Agent, or Firm*—Jacobson Holman PLLC

(57) ABSTRACT

An internal-combustion engine, in particular for a vehicle, is provided with a plurality of cylinders and a cylinder head which defines, for each cylinder, at least one exhaust duct and at least one intake duct; the engine is further provided with an exhaust manifold communicating with the exhaust ducts, and a system for recirculating exhaust gas from the exhaust manifold to the intake ducts; the system comprises a further manifold which distributes the recirculated exhaust gases to the intake ducts and communicates with the exhaust manifold through a recirculation duct provided at least partly directly in the cylinder head which is provided with a heat exchanger for cooling the recirculated exhaust gases.

8 Claims, 4 Drawing Sheets

INTERNAL-COMBUSTION ENGINE PROVIDED WITH AN EXHAUST GAS RECIRCULATION SYSTEM, IN PARTICULAR FOR A VEHICLE

The present invention relates to an internal-combustion engine provided with a recirculating system for exhaust gases and, in particular, to a internal-combustion engine of the diesel type for a vehicle, to which the following description refers without thereby implying any restriction.

BACKGROUND OF THE INVENTION

It is known that internal-combustion engines comprise a plurality of cylinders and a cylinder head which, for each cylinder, has at least one intake duct for outside air and at least one exhaust duct which communicates with an exhaust manifold adapted to convey the exhaust gases from all the exhaust ducts associated with the cylinders.

Engines are known which are provided with systems for recirculating the exhaust gases so as to recirculate some of the gases from exhaust manifold to the intake ducts, in particular for the purpose of containing polluting emissions based on nitrogen oxides with in preset limits. These recirculation systems, which are commonly denoted by the acronym EGR ("exhaust gas recirculation"), comprise a control valve operated by suitable means for varying the flow rate of the exhaust gases bled from the exhaust manifold, and a recirculation pipe interposed between the exhaust manifold and a further manifold adapted to distribute said gases into the intake ducts.

In general, the EGR system further comprises a heat exchanger, normally of plate type, which is arranged in series with the recirculation pipe and which is adapted to lower the temperature of the recirculated gases so as to improve the efficiency of the system and the efficiency of the engine.

The known EGR systems of the type just described are expensive as a result of using a heat exchanger having characteristics which are compatible with the exhaust gases, and they have relatively long assembly times since they require a relatively large number of components to be attached and connected to one another, such as the heat exchanger and the various lengths of piping, it being necessary, however, to ensure satisfactory fluidtightness in the various couplings between the components themselves.

Moreover, the designing of the aforesaid components has to take into account the thermal distortion differing from one component to another, with the provision of expensive and delicate thermal compensation elements, for example bellows-type pipes.

Furthermore, the amount of space occupied by the heat exchanger can cause difficulties in the designing of the lay-out of the various units to be accommodated in the engine compartment, as well as in the operations of mounting/dismounting, periodical inspection and maintenance of the units themselves in the engine compartment.

SUMMARY OF THE INVENTION

The object of the present invention is to devise an internal-combustion engine, in particular for a vehicle, which makes it possible to solve the above-mentioned problems in a simple and economical manner.

An internal-combustion engine, in particular for a vehicle, is devised according to the present invention, comprising a plurality of cylinders; a cylinder head defining, for each cylinder, at least one exhaust duct for the exhaust gases and at least one intake duct; an exhaust manifold communicating with said exhaust ducts; and a system for recirculating exhaust gas from said exhaust manifold to said intake ducts, and comprising a distribution manifold for distributing the recirculated exhaust gases to said intake ducts, and a recirculation duct extending between said exhaust and distribution manifolds; characterised in that at least one portion of said recirculation duct is provided directly in said cylinder head; said cylinder head comprising heat exchange means for cooling said recirculated exhaust gases.

BRIEF DESCRIPTION OF THE DRAWINGS

The invention will now be described with reference to the accompanying drawings which illustrate a nonrestrictive example of embodiment thereof, wherein.

DETAILED DESCRIPTION OF THE INVENTION

Figure 1:
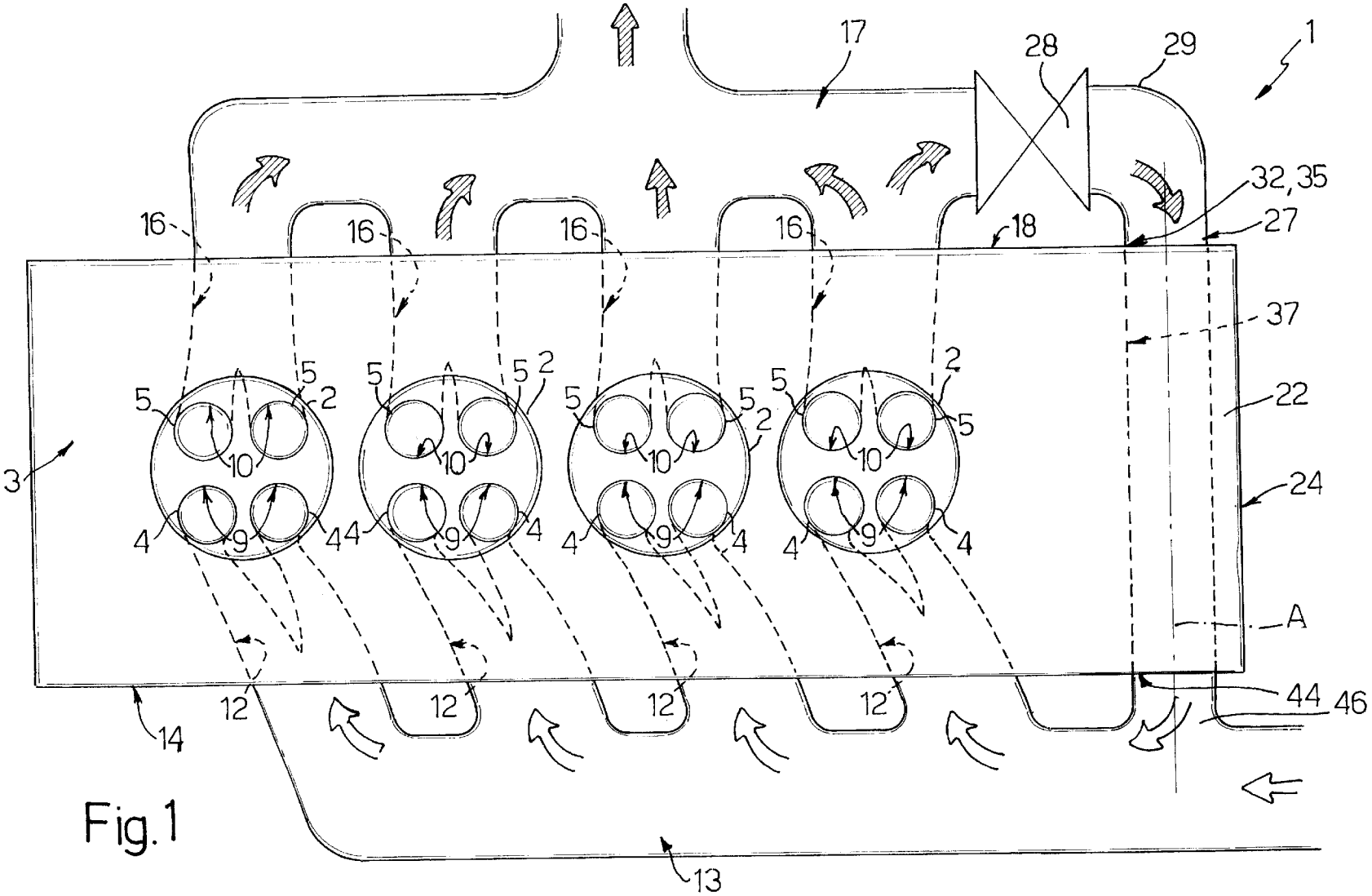
FIG. 1 illustrates, schematically and in plan view, a preferred embodiment of the internal-combustion engine provided with an exhaust gas recirculation system designed in accordance with the present invention.

In FIG. 1 the reference numeral 1 denotes an internal-combustion engine, in particular a internal-combustion engine of diesel type for a commercial vehicle (not shown). The engine 1 (illustrated schematically) comprises a plurality of cylinders 2 (the outline of which is indicated in solid line in FIG. 1) and a cylinder head 3 which is made of light alloy and has, for each cylinder 2, a pair of inlet valves 4 and a pair of exhaust valves 5 (the outline of which is also indicated in solid line in FIG. 1). The valves 4 and 5 are controlled by a timing assembly, which is known and not shown, for controlling the opening and closing of associated ports provided in said cylinder head 3 and denoted by the reference numbers 9 and 10, respectively.

The ports 9 communicate, through associated intake ducts 12, with an intake manifold 13 (illustrated schematically) which is securely connected in a known manner (not shown) fluidtightly to a surface of the cylinder head 3 defining the intake side 14 for conveying outside air to said ducts 12.

On the other hand, the ports 10 communicate, through associated exhaust ducts 16, with an exhaust manifold 17 (illustrated schematically in FIG. 1) which is securely connected in a known manner(not shown) fluidtightly to a surface of the cylinder head 3 defining the exhaust side 18 for conveying the exhaust gases to an exhaust system (not shown) of the vehicle.

Figure 2:
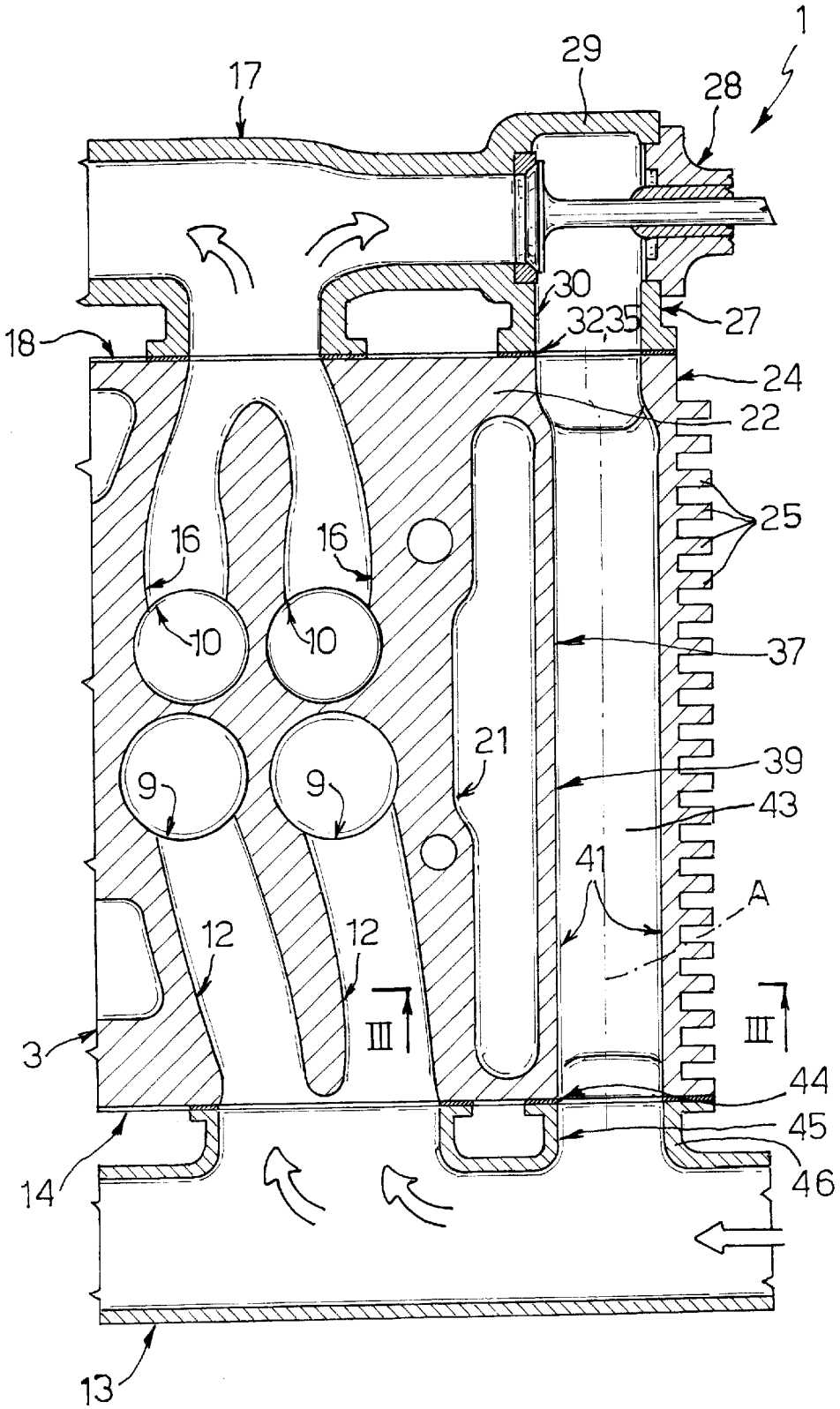
FIG. 2 illustrates, in section and on an enlarged scale, a detail of FIG. 1.

With reference to FIG. 2, the cylinder head 3 comprises a plurality of chambers forming part of a cooling circuit of the engine 1, through which coolant passes. In particular, one of these chambers, denoted by the reference numeral 21, is provided in a lateral portion 22 of the cylinder head 3 bounded by the intake side 14, by the exhaust side 18 and by a outer lateral surface 24, from which project integrally a plurality of heat-exchange fins 25 disposed by side by side and orthogonal to the plane of FIG. 2.

With further reference to FIG. 2, the engine 1 is provided with an exhaust gas recirculation system 27, commonly denoted by the acronym EGR ("exhaust gas recirculation"), which is designed to recirculate part of the exhaust gas from the manifold 17 to the ducts 12. The system 27 comprises a valve 28 (illustrated schematically in FIG. 1 and partly in FIG. 2) which is integrated in an end portion 29 of the manifold 17 and which is controlled by an electronic processor of known type (not shown) for controlling the opening/closing of a passage 30 provided in the portion 29 and for varying the flow rate of exhaust gas bled off through said passage 30.

The portion 29 is coupled fluidtightly with the lateral surface 22 of the cylinder head 3 so as to communicate the outlet 32 of the passage 30 with the inlet 35 of a duct 37.

Figure 3:
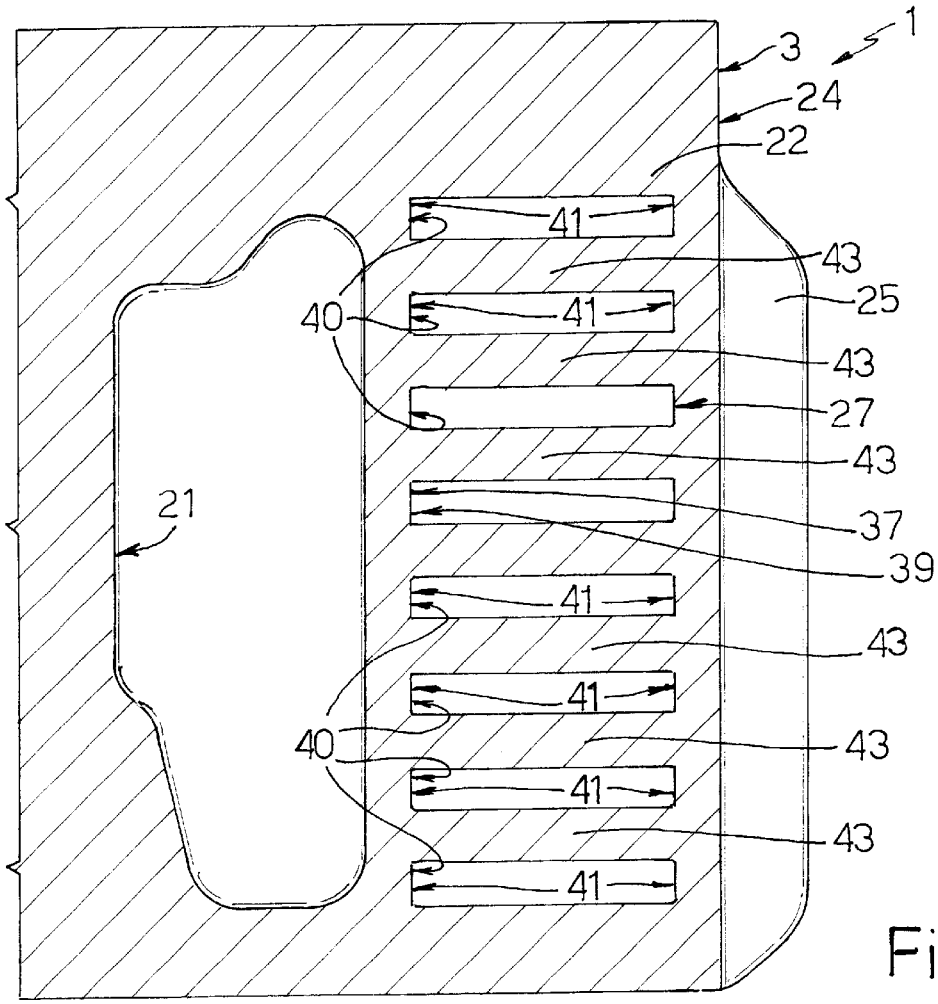
FIG. 3 is a section, with parts omitted for clarity, along the line III—III in FIG. 2.

As illustrated in FIGS. 2 and 3, the duct 37 is formed directly in the lateral portion 22 from the exhaust side 18 to the intake side 14 in a direction A parallel to the surface 24, in a position adjacent the chamber 21 and intermediate between the surface 24 and said chamber 21.

The duct 37 conveys the gases bled off from the valve 28 and comprises an intermediate portion 39 divided up into mutually parallel channels 40 by a plurality of intermediate baffles 43 which are formed integrally with the lateral portion 22, which extend substantially between the chambers 21 and the surface 24 parallel to the direction A, and which are orthogonal, in particular, to the surface 24 and to the fins 25.

Each channel 40 is of rectangular cross-section (FIG. 3) and is bounded by said baffles 43 and by two lateral surfaces 41 which are opposite one another and one of which is disposed on the side of the surface 24 and the other of which is disposed on the side of the chamber 21.

The duct 37 has an outlet 44 which is provided on the intake side 14 and communicates with a passage 45 provided in a portion 46 of the intake manifold 13. The portion 46 is coupled fluidtightly with the lateral portion 22 so as to admit the recirculated exhaust gases into the flow of outside air entering the engine 1. In particular, the manifold 13, in which the mixing of the recirculated gas with the outside air takes place, comprises means and piping of known type (not shown in FIGS. 1 and 2) which are indispensable for the uniform distribution of said gases in the various intake ducts 12.

Figure 4:
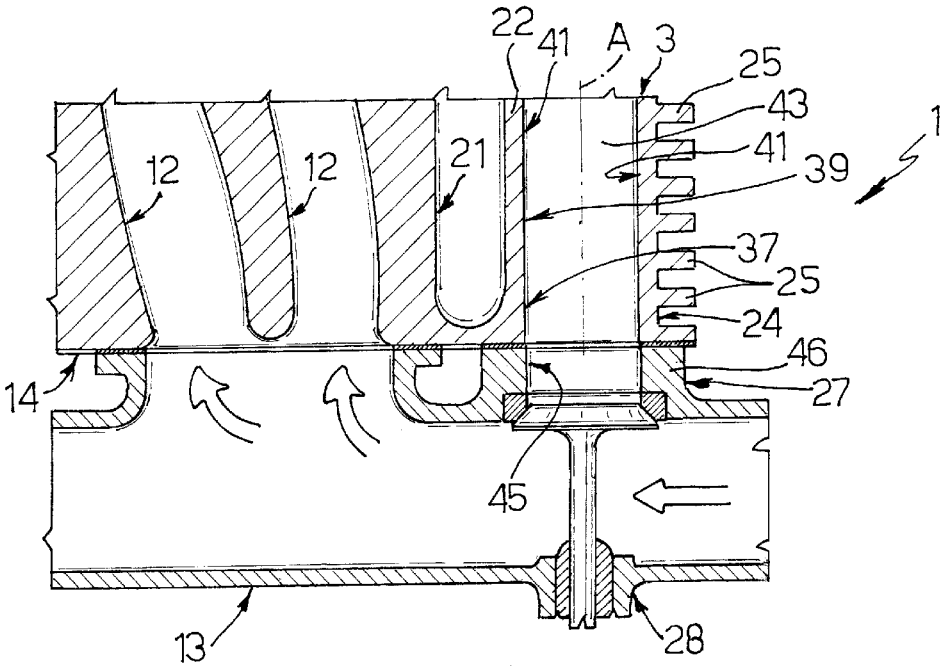
FIG. 4 is analogous to FIG. 2 and illustrates, with parts omitted and on a slightly reduced scale, a variant according to which a control valve of the exhaust gas recirculation system is disposed in a different position to that in FIG. 2.

The variant illustrated in FIG. 4 differs from the solution illustrated in FIGS. 1 to 3 in that the valve 28 (partly shown) is integrated in the portion 46 of the manifold 13 rather than in the portion 29 of the manifold 17 so as to control the opening/closing of the passage 45 downstream of the duct 37.

According to a variant of embodiment which is not illustrated, the outlet 44 of the duct 37 communicates with a manifold which is different from the manifold 13 and adapted to distribute the exhaust gases to the various intake ducts 12.

Figure 5:
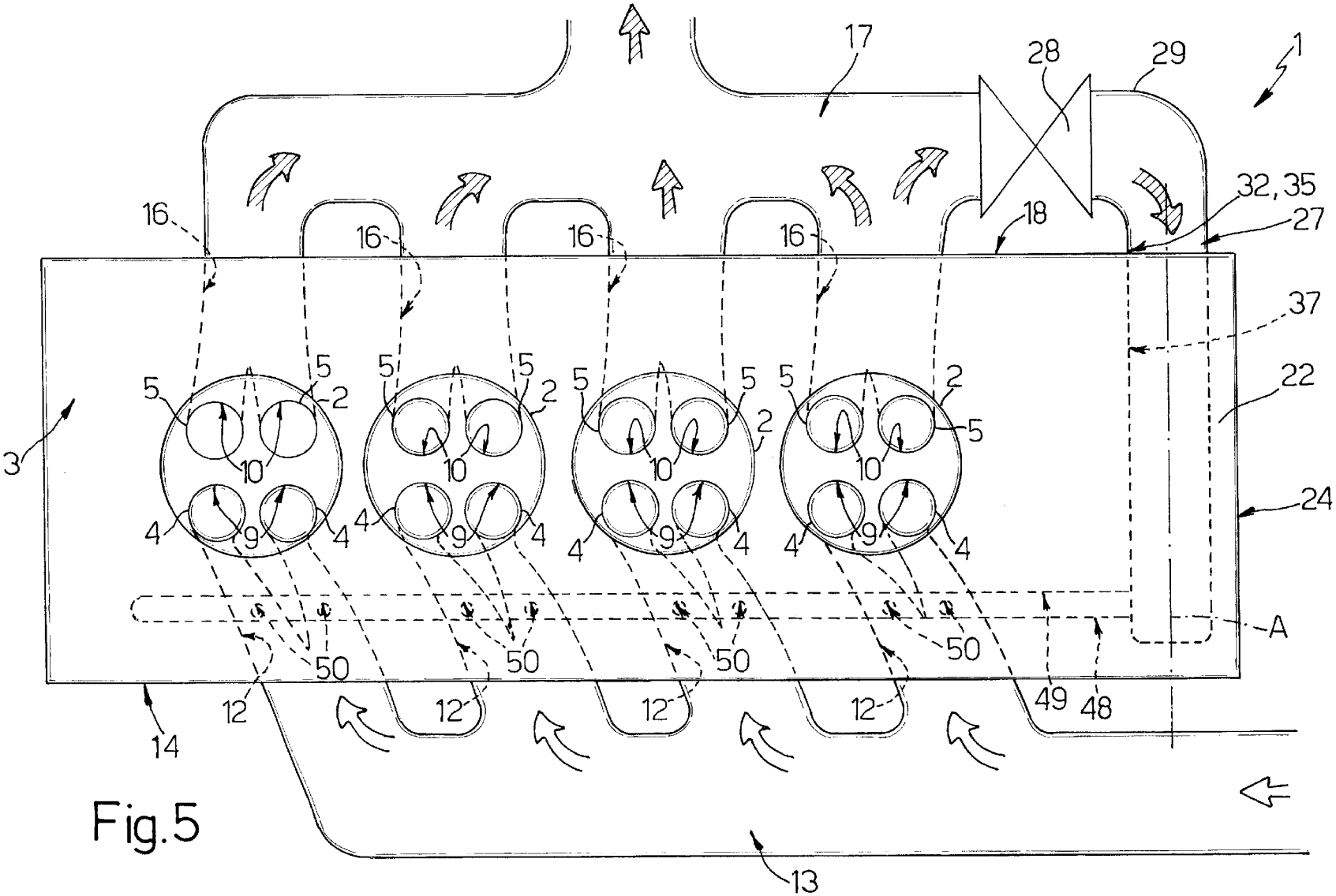
FIG. 5 is analogous to FIG. 1 and illustrates another variant of the engine in FIG. 1.

According to the variant illustrated in FIG. 5, the duct 37 communicates, downstream, with a manifold 48 provided directly in the cylinder head 3 and adapted to distribute the exhaust gases directly into the ducts 12. The manifold 48 comprises a blind channel 49 communicating with the duct 37 and extending along the intake side 14 in a position adjacent all the ducts 12, and a plurality of holes 50, each of which extends between said channel 49 and an associated intake duct 12.

In the production stage of the engine 1 the duct 37 is obtained directly during the production of the light alloy casting of the cylinder head 3. In the assembly stage of the engine 1 and the system 27 it is merely necessary to couple the manifolds 13 and 17 to said cylinder head 3, a fluidtight seal being assured at the inlet 35 and at the outlet 44 of the duct 37 by means of gaskets of known type.

In operation, the duct 37 passing through the cylinder head 3 directly communicates the manifolds 17 with the manifold 13 or 48 and, at the same time, the lateral portion 22 defines a heat exchanger comprising, on the one hand, the surfaces 41 and the baffles 43 and, on the other hand, the chamber 21 and the fins 25 for cooling the recirculated exhaust gases.

In fact, some of the heat of the exhaust gases conveyed into the duct 37 is transferred to the lateral portion 22 through the baffles 43 and the surfaces 41, and is transmitted through said lateral portion 22 by conduction. The cooling liquid circulating in the chamber 21, on the one hand, and the outside air which acts on the fins 25, on the other hand, continuously remove heat from the lateral portion 22 thereby reducing the temperature of the exhaust gases recirculated to the manifold 13,48.

It is evident from the foregoing that the cylinder head 3 incorporates both the function of recirculating the exhaust gases from the exhaust side 18 to the intake side 14, and the function of heat exchange for cooling the recirculated gases. Therefore, on the one hand, the system 27 has reduced production costs, in view of the fact that the heat exchanger defined by the lateral portion 22 is formed in the casting of the cylinder head 3 and, on the other hand, has extremely short assembly times. In fact, it is merely necessary to couple the manifolds 13 and 17 to the cylinder head 3, without it being necessary to attach either an external heat exchanger or lengths of pipe for connecting the manifolds 13,17, as in the known solutions.

For the same reasons, the system 27 occupies very little space and thereby facilitates, with respect to the known solutions, the planning of arrangement of the various units in the engine compartment and the operations of mounting/dismounting, periodical inspection and maintenance of the units themselves.

Furthermore, it is apparent from the foregoing that there are no interconnected components which are subject to differential thermal expansion and which are not already present in engines which do not have an EGR system, such as the cylinder head and the exhaust manifold, and that is thus not necessary to provide expensive and delicate thermal compensation elements.

Finally, it is evident from the foregoing that the engine 1 described can be subject to modifications and variations which do not depart from the scope of protection of the present invention.

In particular, the duct 37 could be provided only in part of the cylinder head 3 and/or the cooling of the exhaust gases could be carried out by way of a different structure from that indicated, for example by providing fins in the chamber 21, and/or by providing the duct 37 in an intermediate position between two cooling chambers 21.

Furthermore, the baffles 43 could be undulating in the direction A so as to increase the surface acted upon by the gases which pass through the channels 40, and/or the valve 28 could be partly integrated into the cylinder head 3.

Finally, the engine 1 could operate in accordance with the otto cycle rather than the diesel cycle and/or it could be employed in other sectors than the automobile sector.

What is claimed is:

1. An internal-combustion engine, in particular for a vehicle, comprising a plurality of cylinders; a cylinder head defining, for each of the cylinders, at least one exhaust duct for the exhaust gases and at least one intake duct; an exhaust manifold communicating with said exhaust ducts; and a system for recirculating exhaust gas from said exhaust manifold to said intake ducts, and comprising a distribution manifold for distributing the recirculated exhaust gases to said intake ducts, and a recirculation duct extending between said exhaust manifold and said distribution manifold and having at least one portion which is provided directly in said cylinder head; said cylinder head comprising heat exchange means for cooling said recirculated exhaust gases; said heat exchange means comprising at least one cooling chamber provided in said cylinder head and forming part of a cooling circuit of said engine, and a plurality of heat exchange baffles disposed in said recirculation duct so as to divide one portion of said recirculation duct into a plurality of channels; said heat exchange baffles being formed in one piece with said cylinder head.

2. An engine according to claim 1, characterised in that said channels extend externally with respect to said cooling chamber and with respect to a cooling medium contained in said cooling chamber.

3. An engine according to claim 2, characterised in that said heat exchange baffles are parallel each to the other and extend transversely to said cooling chamber.

4. An engine according to claim 3, characterised in that each channel is bounded by said heat exchange baffles and by two lateral surfaces, which are opposite one another and one of which is disposed on the side of an outer lateral surface of the cylinder head, and the other of which is disposed on the side of said cooling chamber.

5. An engine according to claim 4, characterised in that said heat exchange means comprises a plurality of heat exchange fins, which extend outside said cylinder head on the opposite side of said recirculation duct with respect to said cooling chamber.

6. An engine according to claim 5, characterised in that said heat exchange fins are orthogonal to said heat exchange baffles.

7. An engine according to claim 1, characterised in that said recirculation duct is provided entirely within said cylinder head and has an inlet and an outlet coupled in a fluidtight manner directly to said exhaust manifold and, respectively, to said distribution manifold.

8. An engine according to claim 1, characterised in that said recirculation duct communicates with a distribution manifold which is provided directly in said cylinder head.

* * * * *